United States Patent [19]

Jenkins

[11] Patent Number: 4,963,404

[45] Date of Patent: Oct. 16, 1990

[54] PROCESS FOR THE PRODUCTION OF A COATED PRODUCT, THIN-WALLED COATED CYLINDER OBTAINED BY USING SAID PROCESS, AND AN INK TRANSFER ROLLER COMPRISING SUCH A CYLINDER

[75] Inventor: Jerome D. Jenkins, Wauwatosa, Wis.

[73] Assignee: Stork Screens B.V., Netherlands

[21] Appl. No.: 148,214

[22] PCT Filed: May 4, 1987

[86] PCT No.: PCT/NL87/00009

§ 371 Date: Mar. 3, 1988

§ 102(e) Date: Mar. 3, 1988

[87] PCT Pub. No.: WO87/06627

PCT Pub. Date: Nov. 5, 1987

[30] Foreign Application Priority Data

May 1, 1986 [NL] Netherlands ..... 8601119

[51] Int. Cl.[5] ..... B41N 7/00; C23C 28/00

[52] U.S. Cl. ..... 428/34.7; 29/132; 101/348; 427/34; 427/53.1; 428/35.9

[58] Field of Search ..... 427/34, 53.1; 156/643, 156/645; 101/348; 428/34.6, 35.9, 34.7; 29/132

[56] References Cited

U.S. PATENT DOCUMENTS

| | | | |
|---|---|---|---|
| 4,027,367 | 6/1977 | Rondeau | 427/37 |
| 4,246,842 | 1/1981 | Williams et al. | 101/348 |
| 4,566,938 | 1/1986 | Jenkins | 427/53.1 |

FOREIGN PATENT DOCUMENTS

| | | |
|---|---|---|
| 851077 | 5/1977 | Belgium . |
| 1146817 | 5/1983 | Canada . |
| 0199084 | 10/1986 | European Pat. Off. . |
| 2914255 | 11/1979 | Fed. Rep. of Germany . |
| 3512176 | 10/1986 | Fed. Rep. of Germany . |
| 2333054 | 6/1977 | France . |
| 52-024134 | 2/1977 | Japan . |
| 62-001590 | 1/1987 | Japan . |
| 1517606 | 7/1978 | United Kingdom . |
| 2049102 | 12/1980 | United Kingdom . |

*Primary Examiner*—James Seidleck

*Attorney, Agent, or Firm*—Lucas & Just

[57] ABSTRACT

Process for the production—using plasma spraying—of a coated product in which the coating consists of a ceramic fluorocarbon polymer-comprising coating, while between the surface of the product and the ceramic fluorocarbon polymer-comprising coating an adhesion layer completely of metal is applied. The adhesion layer consists in particular of at least two metals reacting exothermally with each other under plasma spraying conditions. In particular, the product to be coated is a thin-welled nickel, seamless cylinder with a wall thickness of 50–220 μm. The invention also relates to an ink transfer roller in which a thin-walled seamless cylinder obtained by the process according to the invention is used.

5 Claims, 1 Drawing Sheet

PROCESS FOR THE PRODUCTION OF A COATED PRODUCT, THIN-WALLED COATED CYLINDER OBTAINED BY USING SAID PROCESS, AND AN INK TRANSFER ROLLER COMPRISING SUCH A CYLINDER

The invention relates to a process for the production of a coated product, in which a metal-comprising adhesion layer and a ceramic-fluorocarbon polymer-comprising coating are applied to said product by means of plasma spraying.

Such a process is known from U.S. Pat. No. 4,566,938.

The above-mentioned patent describes the application to a roller of an adhesion layer in the form of a mixture of a metal and a fluorocarbon polymer, followed by the application of a ceramic-fluorocarbon polymer-comprising coating. Such a known process has the disadvantage that it can be used only for the coating of rigid products which are not mechanically deformable in normal circumstances. If such a process is used for the coating of a flexible product, adhesion problems between the coating system and the substrate occur during use, which can lead to cracking of the coating layers and even to partial peeling thereof.

The object of the present invention is to produce a solution to the above problem, so that the process can be used for coating flexible products without the coatings applied cracking or peeling during normal use of the coated flexible product.

The process is to that end according to the invention characterized in that an adhesion layer consisting entirely of metal is applied between the surface of the product to be coated and the ceramic-fluorocarbon polymer-comprising coating.

It was surprisingly found that the deformation stability of the ceramic-fluorocarbon polymer-comprising coating increases very considerably if an adhesion layer made entirely of metal is used, unlike the use of an adhesion layer consisting of a mixture of fluorocarbon polymer and metal specified in the above-mentioned U.S. Pat. No. 4,566,938. This greatly improved stability is particularly evident on deformation of the substrate to which the adhesion layer and the ceramic-fluorocarbon polymer-comprising coating have been applied. With normal elastic deformation of the substrate, cracking and possibly peeling no longer occur.

In particular, the process according to the present invention is characterized in that the metal adhesion layer is formed using at least two metals reacting with each other exothermally under plasma spraying conditions.

In that case the adhesion layer expediently consists of a nickel-titanium alloy.

Another very useful adhesion layer is formed by a nickel-aluminium alloy.

In such a nickel-titanium and nickel aluminium adhesion layer the molecular ratio nickel:titatiun or nickel:aluminium is advantageously between 30:70 and 70:30 respectively.

The ceramic constituent of the ceramic-fluorocarbon polymer-comprising coating in the process according to the invention is very advantageously selected from amorphous metal oxides, metal carbides, metal nitrides and metal silicides or mixtures of such substances.

On account of the mechanical properties of the ceramic-fluorocarbon polymer-comprising coating, it has been found advantageous to use amorphous starting materials for the ceramic constituent. It was found that the elasticity of the coating increased particularly if, instead of a crystalline ceramic material, an amorphous ceramic material was used. It was also found that the amorphous nature of the starting materials was retained during the plasma spraying treatment and any further treatments.

In a particular embodiment of the process according to the invention the product to be coated is made of metal between 10 and 1000 μm thick, on which first by plasma spraying a Ni/Ti adhesion layer is formed with 50 mol.-% Ni and 50 mol.-% Ti and between 25 and 500 μm thick, followed by a coating consisting of a thorough mixture of metal, ceramic and fluorocarbon polymer between 75 and 800 μm thick, in which the metal consists of a Ni/Ti alloy with 50 mol.-% Ni and 50 mol.-% Ti, the ceramic part consists of 1–80 wt.-% amorphous titanium dioxide and 99–20 wt.-% amorphous aluminium oxide, and the composition over the thickness of the coating starting from the adhesion coating or first coating varies from 85–0% metal and 10–95% ceramic, while at least 5 wt.-% polytetrafluoroethylene is always present.

The metal of the substrate can, for example, be steel, copper, nickel, aluminium and other commonly used metals and metal alloys.

There are multiple uses for such flexible metal products provided with a ceramic-fluorocarbon polymer-comprising coating. The process described above can be used in all cases where a thin flexible metal object must be provided with a very strongly adhering, non-cracking, electrically insulating, wear-resistant coating layer with low coefficient of friction. One example is the coating of mechanically loaded surfaces in equipment of many kinds; in particular in the full or partial coating of surfaces of rollers the products obtained by means of the above-described process will be of great use.

In another special embodiment to the process of the invention, the product to be coated is a thin-walled nickel seamless cylinder with a wall thickness between 50 and 250 μm.

Such a thin-walled nickel seamless cylinder obtained can be applied, with suitable means known in the art, as a lining on, for example, a roller. Such a roller is provided with a number of gas outflow openings at least at one of the ends of the roller. These gas outflow openings are connected via the inside of the roller to a supply of gas under increased pressure. If the thin-walled cylinder is now slid over a short distance onto the roller, thereby covering the gas outflow openings, and the gas supply to these openings is then opened, the thin-walled nickel cylinder is slightly elastically stretched, so that with simple means the thin-walled cylinder can be slid over the entire length of the supporting roller.

A slightly conical-shaped thin-walled cylinder which can be slid onto an opposite slightly conical-shaped supporting roller can also be selected.

In connection with the above, it is also pointed out that the application of an adhering ceramic-fluorocarbon polymer-comprising coating to a metal product offers very good posibilities for many applications; the use of the process according to the invention is not, however, limited to the application of said coating to a metal product. The process for the application of a very strongly adhering ceramic-fluorocarbon polymer-comprising coating using an adhesion layer consisting entirely of metal can be carried out just as successfully for the coating of a plastic-based material. In the latter case it could, for example, be a glassfibre-reinforced polyester material, in which the glassfibre content is made as high as possible, on account of the plasma spraying conditions.

The invention also relates to a thin-walled cylinder obtained using the process described above, which is characterized in that, after application, the ceramic-fluorocarbon polymer-comprising coating by means of beam treatment is provided with a surface pattern of cavities of the desired shape.

Such a thin-walled coated cylinder is used, inter alia, in ink transfer rollers such as those described below. The form and application of inking rollers is known per se from the earlier-mentioned U.S. Pat. No. 4,566,938. For use in an inking roller such a thin-walled cylinder produced by the process according to the invention can be applied to a substrate in the form of a roller, in the same way as described above for a thin-walled cylinder not provided with a surface pattern of cavities. With the use of such a thin-walled coated cylinder in an ink transfer roller there could also be other fastening means to give the thin-walled cylinder the necessary rigidity. Instead of fastening means in the form of a support, tensioning means fixed in the ends of the cylinder can be selected so that the cylinder can be tensioned in such a way that the surface has sufficient rigidity to permit its use as an inking roller. In order to obtain the necessary rigidity, one can also opt for the use of fastening means for the cylinder which make it possible to place the inside of the cylinder under liquid or gas pressure. In the case of gas pressure the relevant safety regulations will, of course, have to be observed.

In connection with the above-described use of a thin-walled coated cylinder provided with a surface pattern of cavities, also is referred to Dutch Patent Application No. 8,401,401 of Applicants, which describes a process for the production of a screen roller. The said application describes a thin-walled cylindrical sieve which is fitted in clamping fashion to a bearing cylinder by first sealing the perforations of the sieve, then fitting the sieve by means of the earlier-described air slide-on method around a roller provided with openings, and subsequently removing the filling from the perforations of the sieve. The inking roller obtained in that way therefore uses a fully perforated cylinder as the thin-walled seamless cylinder, so that the cavities pattern in the cylinder is determined by the properties of the thin-walled cylinder itself. However, in the process according to the present invention is started from a completely closed thin-walled cylinder, around which a very strongly adhering, mechanically durable ceramic-fluorocarbon polymer-comprising coating is applied, whereby after application of the ceramic coating the form and fineness of the surface pattern of cavities can be freely accepted.

The invention also relates to an inking roller, comprising a substrate having applied thereto a metal-containing adhesion layer and a ceramic fluorocarbon polymer-comprising coating, the latter being provided, after application, with a surface pattern of cavities by means of beam treatment, characterized in that it is formed from a thin-walled coated cylinder which is provided with a surface pattern of hollows of the desired shape and has fastening means for the said cylinder and sealing means, permitting its use as an ink transfer roller as described above.

The above-described inking roller expediently has sealing means, at least having a sealing element to prevent penetration of ink between the fastening means and the cylinder, and a pressure member for such an element. An example of a sealing device such as that referred to above is a plate which is fixed on the shaft of the inking roller, by means of which a sealing ring is pressed against the dividing seam between the thin-walled cylinder and its support.

In particular, the ink transfer roller has sealing means in the form of a sealing cuff, formed by a disc which can be fixed on the shaft of the supporting roller and a flange which is fitted perpendicular to the disc and can connect to the outer surface of the sleeve in the form of a seamless cylinder fixed on the supporting roller, while at least one annular sealing element between cylinder surface and inside of the flange ensures sealing.

In such a cuff the sealing ring is advantageously made of polytetrafluoroethylene, at least on its surface. Use of polytetrafluoroethylene is very advantageous on account of the use of the inking roller in combination with inks which may contain aggressive compounds such as solvents.

With the use of the ink transfer roller according to the invention which, as indicated, may consist of a thin-walled cylinder applied to a solid supporting roller, the problem can arise that ink applied with the roller creeps through capillary action between the cylinder and the supporting roller. This ink can dry there and, if the quantity thereof is sufficiently great, can give rise to irregularities in the surface of the thin-walled sleeve. During use of such an inking roller, it generally turns in a tank containing ink or dye, so that dye is taken up while the excess is scraped off, for example with the aid of a steel squegee. Unevennesses in the surface of the thin-walled sleeve due to ink penetration can lead to excessive wear of squeegee and/or sleeve, and in serious cases can lead to tearing away of the thin-walled sleeve from the surface of the bearing roller. In any case the penetration of ink between thin-walled sleeve and bearing roller must therefore be avoided. Through the use of the above-mentioned sealing means such ink penetration is effectively prevented.

It is pointed out that the above-described sealing means can be very advantageously used in combination with an ink transfer roller formed according to the invention; the use is not, however, restricted to that. Use can also be made of the cuff for other rollers which are provided with a detachable inking surface.

The invention will be explained in greater detail below with reference to the drawing, in which:

BRIEF DESCRIPTION OF THE DRAWING:

In FIG. 1 the inking roller is indicated by reference number 1, while 2, 3 and 4 indicate the roller element, the shaft journal and the shaft. Disposed on the roller element is a thin-walled cylinder 5 provided with a cavity pattern. Reference numbers 6 and 7 indicate the disc and the flange connecting to the outer surface, with the sealing ring 8 taking care of the sealing which prevents ink from penetrating between the thin-walled cylinder clamped on the supporting roller and the supporting roller.

FIG. 2 again indicates by 5 the wall of the thin-walled cylinder shown in FIG. 1, 11 indicates the earlier-discussed adhesion layer of metal, and 12 is the ceramic-fluorocarbon polymer-comprising coating applied to the adhesion layer.

Figure 1:
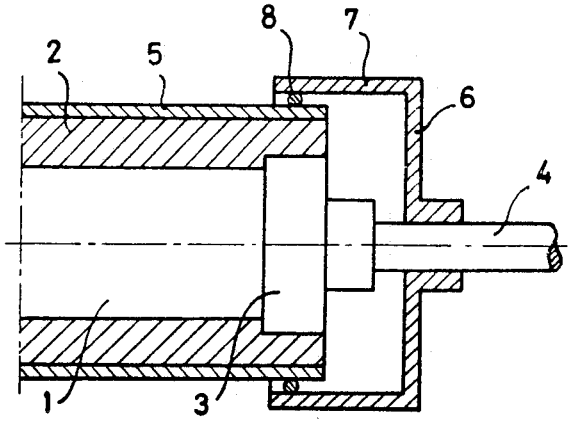
FIG. 1 shows a cross section through an inking roller according to the invention with a sealing cuff provided thereon.
Figure 2:
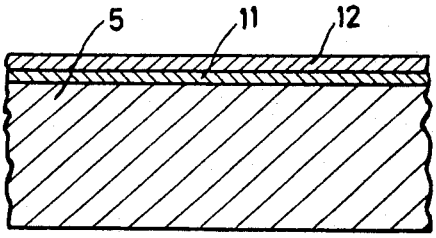
FIG. 2 shows a cross section on an enlarged scale through the wall of a thin-walled cylinder used according to the invention.

I claim:

1. An ink transfer roller comprising a thin-walled coated cylinder obtained by a process in which an adhesion layer consisting of metal and a coating comprising a mixture of a ceramic and fluorocarbon polymer are each applied by means of plasma spraying to a cylinder to be coated, said adhesion layer being between the surface of said cylinder to be coated and said coating, said adhesion layer being formed by plasma spraying using at least two metals reacting with each other exothermally under plasma spraying conditions, said coating being provided with a surface pattern of cavities by means of beam treatment, said roller also comprising fastening means for said cylinder enabling said cylinder to be used as an ink transfer roller, said ink transfer roller further having sealing means to prevent deposition of ink between said cylinder and said fastening means.

2. The ink transfer roller of claim 1, in which the sealing means comprises a sealing element and a pressure member for said sealing element.

3. The ink transfer roller of claim 1, wherein:

the cylinder to be coated is a metal cylinder with a wall thickness between 10 and 1000 μm;

said adhesion layer is between 25 and 500 μm thick, and consists of a nickel/titanium alloy in a 50:50 molar ratio;

said coating consists of a mixture of metal, ceramic, and fluorocarbon polymer and has a total thickness between 75 and 800 μm, the metal being a nickel-/alumimum alloy in a 50:50 molar ratio, the ceramic being between 1 and 80% by weight of the total ceramic content amorphous titanium oxide and between 99 and 20% by weight of the total ceramic content amorphous aluminum oxide, the fluorocarbon polymer being polytetrafluoroethylene; and the composition over the total thickness of the metal/ceramic/fluorocarbon coating varies from 85–0% metal and 10–95% ceramic, with at least 5% by weight polytetrafluoroethylene always being present.

4. An ink transfer roller comprising:

a thin-walled coated cylinder obtained by a process in which an adhesion layer consisting of metal and a coating comprising a mixture of a ceramic and fluorocarbon polymer are each applied by means of plasma spraying to a cylinder to be coated, wherein said adhesion layer is between the surface of the cylinder to be coated and said coating, said adhesion layer being formed by plasma spraying using at least two metals reacting with each other exothermally under plasma spraying conditions, and said coating being provided with with a surface pattern of cavities by means of beam treatment;

fastening means for said cylinder enabling said cylinder to be used as an ink transfer roller, said fastening means consisting of a roller which supports said cylinder, said roller having a shaft;

sealing means to prevent deposition of ink between said cylinder and said fastening means, said sealing means comprising a sealing element and a pressure member for said sealing element;

said pressure element being a cuff formed by a disc which can be fixed on said shaft of said supporting roller and a flange which is fitted perpendicular to said disc, said flange being abble to be connected to the outer surface of said cylinder fixed on the supporting roller; and said sealing element being at least one annular element between the surface of said cylinder and the inside of said flange, at least the surface of said sealing element being of polytetrafluoroethylene.

5. The ink transfer roller of claim 4 wherein at least the surface of said sealing element is of polytetrafluoroethylene.

* * * * *